US011160376B2

(12) United States Patent
Gass et al.

(10) Patent No.: US 11,160,376 B2
(45) Date of Patent: Nov. 2, 2021

(54) DESK SHIELD

(71) Applicants: Brian Gass, Orange, CA (US); Steve Ehret, Orange, CA (US)

(72) Inventors: Brian Gass, Orange, CA (US); Steve Ehret, Orange, CA (US)

( * ) Notice: Subject to any disclaimer, the term of this patent is extended or adjusted under 35 U.S.C. 154(b) by 0 days.

(21) Appl. No.: 16/931,909

(22) Filed: Jul. 17, 2020

(65) Prior Publication Data

US 2020/0352332 A1 Nov. 12, 2020

(51) Int. Cl.

| | |
|---|---|
| ***A47B 97/00*** | (2006.01) |
| ***A47B 83/04*** | (2006.01) |
| ***A47B 41/00*** | (2006.01) |

(52) U.S. Cl.

CPC ..... *A47B 97/00* (2013.01); *A47B 83/04* (2013.01); *A47B 41/00* (2013.01); *A47B 2200/12* (2013.01)

(58) Field of Classification Search

CPC ..... A47B 97/00; A47B 2200/12; A47B 2200/0084; A47B 37/00; A47B 41/00; A47B 83/04; A47B 96/04

See application file for complete search history.

(56) References Cited

U.S. PATENT DOCUMENTS

| | | | | |
|---|---|---|---|---|
| 2,942,924 | A * | 6/1960 | Stangert | A47B 21/03 312/140.4 |
| 3,326,147 | A * | 6/1967 | Toney | A47B 17/00 108/27 |
| 3,389,947 | A * | 6/1968 | Kelley | E04H 1/1255 312/258 |
| 4,828,132 | A * | 5/1989 | Francis, Jr. | B65D 11/1853 220/6 |
| 5,890,782 | A * | 4/1999 | Alberts | A47B 17/00 312/196 |
| 6,427,609 | B1 * | 8/2002 | Grant | E04H 1/1255 108/60 |
| D560,072 | S * | 1/2008 | Willis | D6/332 |
| D691,402 | S * | 10/2013 | Parker | A47B 97/00 D6/643.1 |
| 9,310,615 | B2 * | 4/2016 | Allen | G02B 27/0018 |
| D760,318 | S * | 6/2016 | Petrocelli | D20/10 |
| 2005/0183639 | A1 * | 8/2005 | O'Leary | A47B 83/001 108/60 |
| 2012/0304441 | A1 * | 12/2012 | Henriott | A47B 13/00 29/428 |

(Continued)

OTHER PUBLICATIONS

Wuhan schools story Billie Thompson from DailyMail.com printout from internet archive May 8, 2020 (Year: 2020).*

*Primary Examiner* — Daniel J Rohrhoff
(74) *Attorney, Agent, or Firm* — Averill & Green; Kenneth L. Green

(57) ABSTRACT

A desk or table shield includes a clear face and two wings, is individually assignable, easily attached to a desk or table top, and include elbow openings preventing or reducing interference with arms during use. Clips are permanently attached to the desk or table top, and the shield engages and disengages from the clips to attach and detach from the desk or table. A template facilitates portioning the clips for attachment to the desk or table top. The wings are attached to the face by flexible hinges. Cable cutouts are provided for cabling. Carrying handles are provided by slots in the face and wings which align when the wings are folded against the face for carrying.

14 Claims, 3 Drawing Sheets

(56) References Cited

U.S. PATENT DOCUMENTS

| | | | | |
|---|---|---|---|---|
| 2013/0291768 | A1* | 11/2013 | Kiskis | A47B 41/00<br>108/60 |
| 2019/0365101 | A1* | 12/2019 | Udagawa | A47B 21/00 |

* cited by examiner

DESK SHIELD

BACKGROUND OF THE INVENTION

The present invention relates to Personal Protective Equipment (PPE), and in particular to a personal shield provided individually to students and others to temporarily attach to student desk or table to block the transmission of a virus.

The current corona virus pandemic has caused a devastating disruption to schools, work, social gatherings, and basically to human activity associated with groups of participants. This disruption is having a terrible affect on education and business activities. Clear shields have been used to provide a barrier between individuals, but known shields are not easily attached and detached from a desk or table allowing individual use, and are not ergonomically suitable for student desk use.

BRIEF SUMMARY OF THE INVENTION

The present invention addresses the above and other needs by providing a desk or table shield which includes a clear face and two wings, is individually assignable, easily attached to a desk or table top, and include elbow openings preventing or reducing interference with arms during use. Clips are permanently attached to the desk or table top, and the shield engages and disengages from the clips to attach and detach from the desk or table. A template facilitates portioning the clips for attachment to the desk or table top. The wings are attached to the face by flexible hinges. Cable cutouts are provided for cabling. Carrying handles are provided by slots in the face and wings which align when the wings are folded against the face for carrying.

In accordance with one aspect of the invention, there is provided a desk or table shield assignable to individual students. The shield is easily attached and detached from a desk or table top. When folded, handle slots in the face and wings align making the folded shield easily to carry by a student. Because the shield is individually assigned, the risk of infection is substantially reduced.

In accordance with another aspect of the invention, there is provided a desk or table shield having elbow openings in wings. The elbow openings allow a student to comfortably work at a desk or table.

In accordance with another aspect of the invention, there is provided a desk or table shield having hinged wings, the hinges made from a flexible material. The hinges are preferably rubber or cloth.

In accordance with yet another aspect of the invention, there is provided a desk or table shield having a fold down work surface. The work surface folds against the face when not in use, and provides a clean surface for class work.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1:
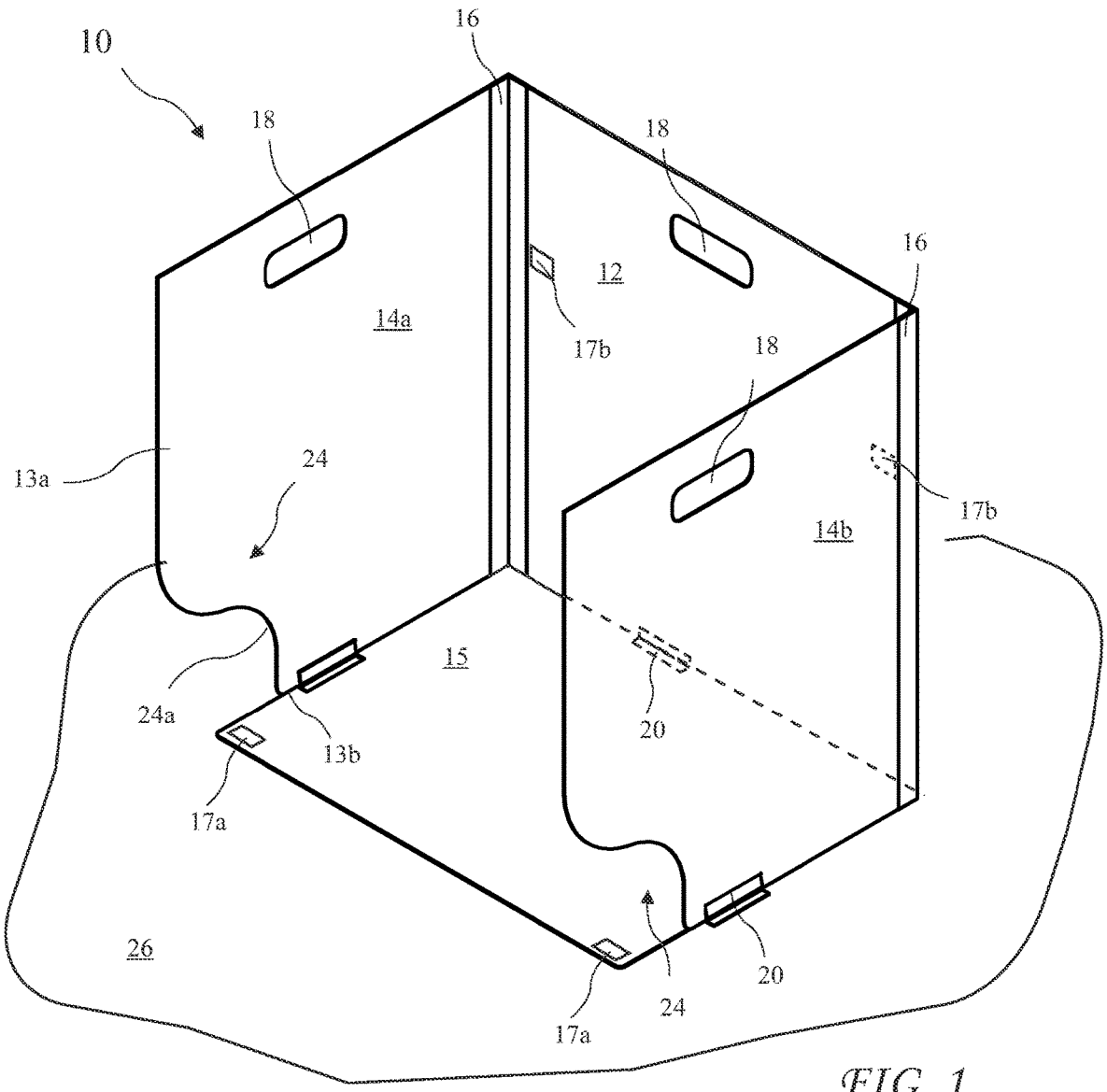
FIG. 1 shows a desk or table top shield according to the present invention.

A desk or table top shield 10 according to the present invention is shown attached to a desk or table top 11 in FIG. 1. The shield 10 includes a face 12 and wings 14*a* and 14*b*. The wings 14*a* and 14*b* include elbow cutouts 24 allowing better use of the table or desk top 11. Clips 20 are permanently (i.e., not readily removed) attached to the desk or table top 11 and the f ace 12 and the wings 14*a* and 14*b* detachably engage the clips 20 to retain the shield 10 on the desk or table top 11. The wings 14*a* and 14*b* are connected to the face 12 by flexible hinges 16, preferably rubber or cloth hinges, and more preferably rubber hinges, for example, two inch wide Polyvinyl Chloride (PVC) tape, vinyl, or polyester ballistic nylon hinges. A fold down work surface 15 folds against the face 12 and may include fasteners 17*a* engaging fasteners 17*b* to retain against the face 12.

The face 12 and the wings 14*a* and 14*b* include handle slots 18 which align when the face 12 and wings 14*a* and 14*b* are folded against the face 12 for easy carrying by a student. Cable slots 22 may be provided along the bottom of the face 12 or the wings 14*a* and 14*b* to run cables into a work space top 26. The face 12 and wings 14*a* and 14*b* are preferably made from a transparent polyester polymer, for example, Polyethylene Terephthalate (PET).

Figures 2A, 2B, 2C:
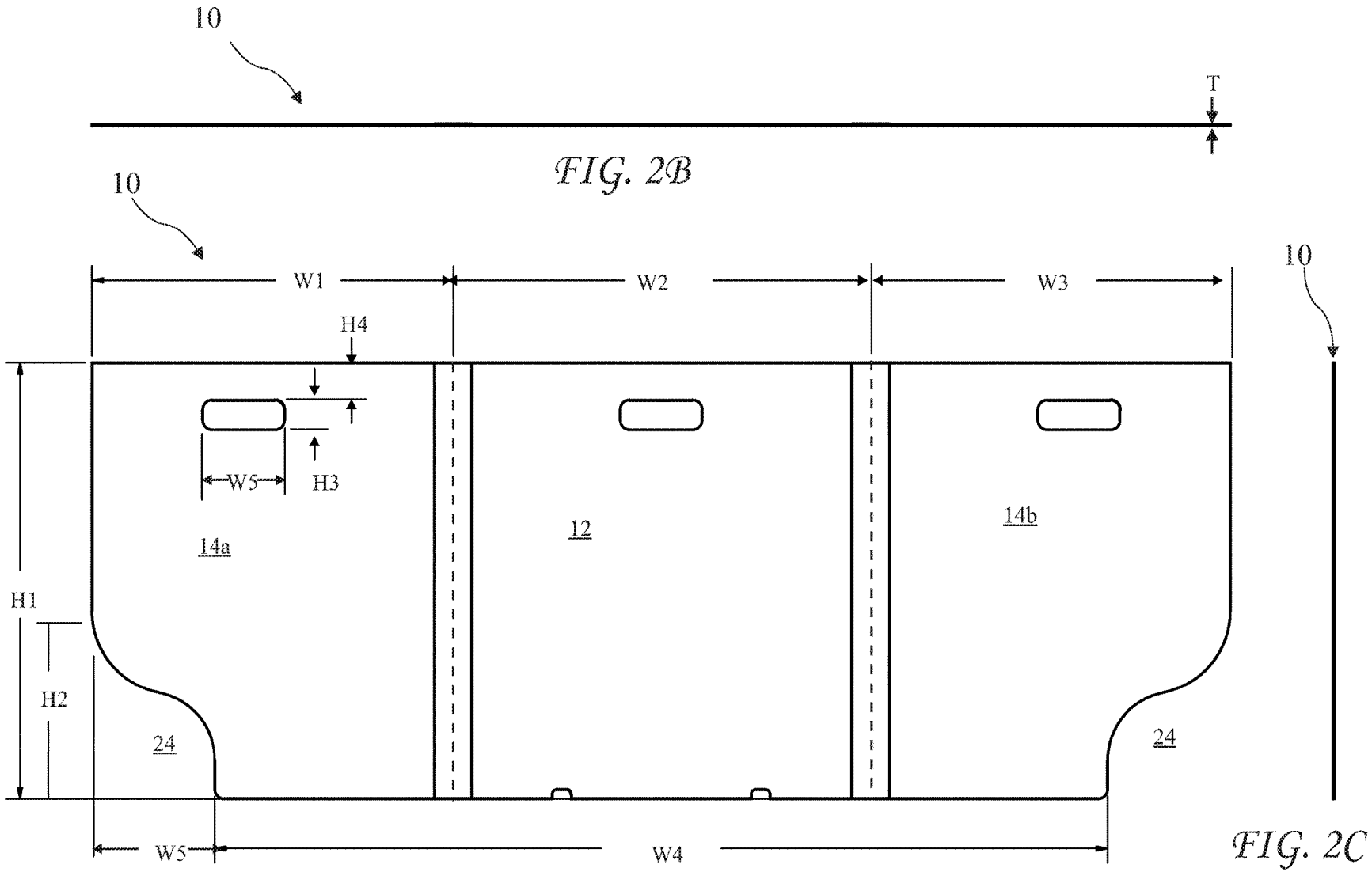
FIG. 2A shows a front view of the shield with wings according to the present invention in the same plane as the face.
FIG. 2B shows a top view of the shield with wings according to the present invention in the same plane as the face.
FIG. 2C shows a side view of the shield with wings according to the present invention in the same plane as the face.

A front view of the wings 14*a* and 14*b* in the same plane as the face 12 is shown in FIG. 2A, a top view of wings 14*a* and 14*b* in the same plane as the face 12 is shown in FIG. 2B, and a side wings 14*a* and 14*b* in the same plane as the face 12 is shown in FIG. 2C. The face 12 has a width W2, the left wing 14*a* has a width W1, and the right wing 14*b* has a width W3. The widths W1 and W3 are preferably about 19 inches and more preferably are 19 inches. The width W2 is preferably about 22 inches and more preferably is 22 inches. The face 12 and wings 14*a* and 14*b* preferably have the same height H1 and same thickness T. The height H1 is preferably about 23 inches and more preferably is 23 inches.

The slots 18 have a width W5 and height H3, and a height H4 below a top edge of the face 12 and wings 14*a* and 14*b*. The width W5 is preferably about 4.33 inches and more preferably is 4.33 inches, the height H3 is preferably about 1.57 inches and more preferably is 1.57 inches, and the height H4 is preferably about two inches and more preferably is two inches The elbow cutouts 24 have a width W5 and a height H2 and have rounded corners having a continuous S shape starting as a downward extension of rear edges 13*a* of the wings 14*a* and 14*b* and having a concave bottom portion 24*a* reaching to the bottom edge 13*b* of the wings 14*a* and 14*b* and preferably no sharp corners. The width W5 is preferably about 6.5 inches and more preferably is 6.5 inches and H2 is preferably about nine inches and more preferrably is nine inches. The thickness T is preferably about 0.060 inches and more preferably is 0.060 inches.

Figure 3B:
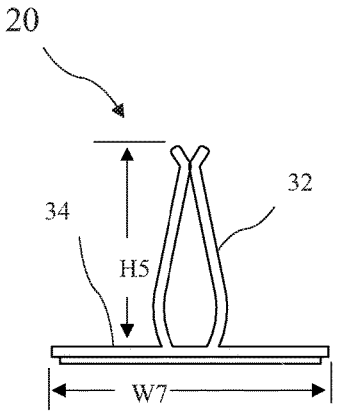
FIG. 3B is an end view of the clip for attachment of the shield with wings according to the present invention.
Figure 3A:
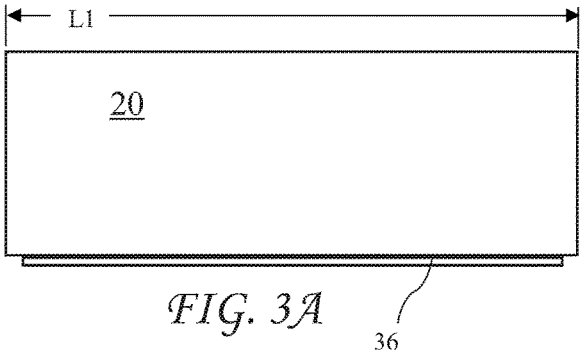
FIG. 3A is a side view of a clip for attachment of the shield with wings according to the present invention.

A side view of a clip 20 for attachment of the shield with wings 10 is shown in FIG. 3A and an end view of the clip 20 is shown in FIG. 3B. The clips 20 have lips 32, a base 34, and adhesive 36 for attachment to the work space top 26. The adhesive 36 is preferably as double sided tape. The clips 20 have a height H5, a length L1, and a base width W7. The height H3 is preferably between 0.5 and 1.5 inches, more preferably about 0.866 inches, and most preferably is 0.866 inches. The length L1 is preferably between two and eight inches, more preferably about three inches, and most preferably is three inches. The width W7 is preferably between 0.5 and two inches, more preferably about one inch, and most preferably one inch. The clip 20 is preferably made from PVC.

Figure 4:
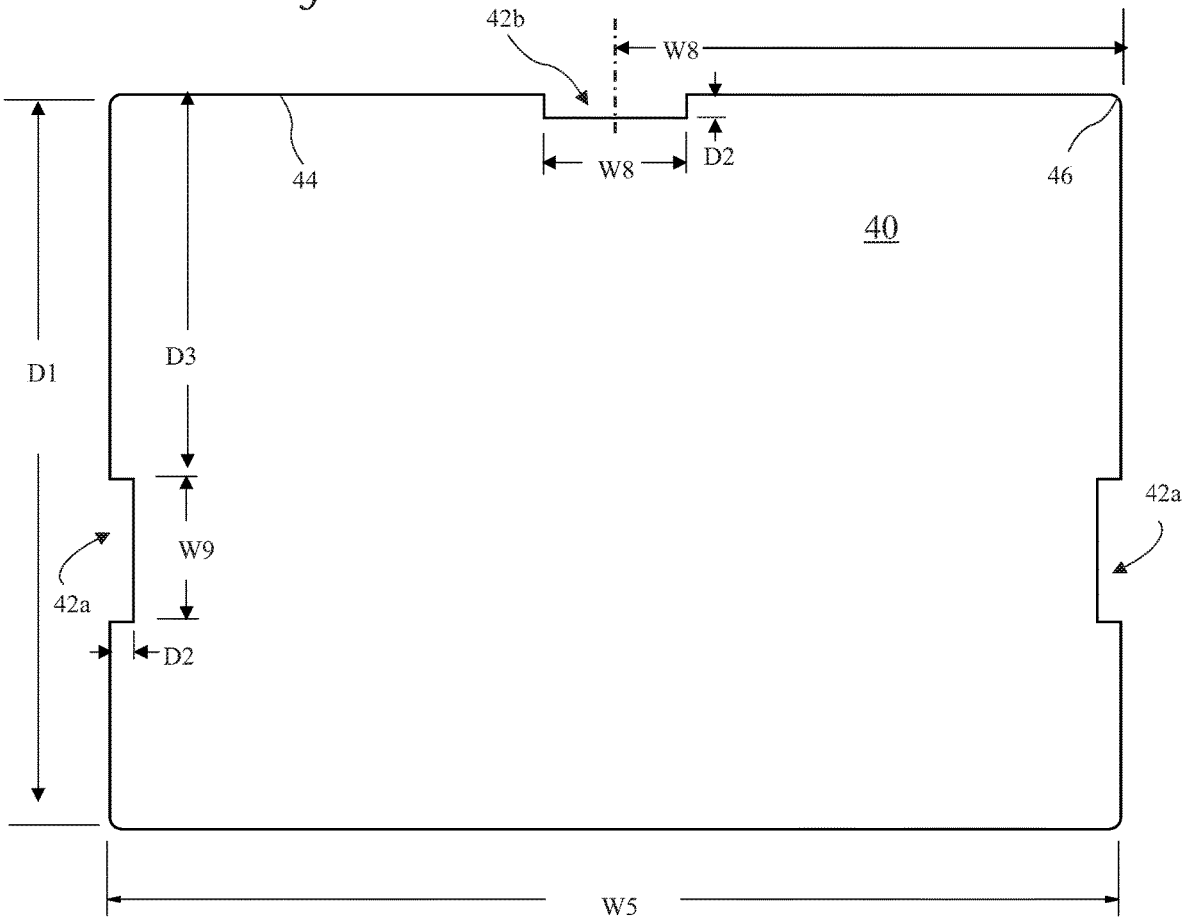
FIG. 4 is a clip template for the shield with wings according to the present invention.

FIG. 4 is a clip template 40 for the shield 10 is shown in FIG. 4. The template 40 has a width W5 and a depth D1. The width W5 is preferably about 22 inches and more preferably is 22 inches. The depth D1 is preferably about 16 inches and more preferably is 16 inches. The template 40 cutouts 42*a* and 42*b* for locating the clips 20. The cutouts 42*a* are on sides of the template 40 and have a width W9, a depth D2, and are a depth D3 from a rear edge 44 of the template 40. The width W9 is preferably about 3⅛ inches and more preferably is 3⅛ inches. The depth D2 is preferably about ½ inches and more preferably is ½ inches. The depth D3 is preferably about 8⅜ inches and more preferably is 8⅜ inches. The template 40 has rounded corners 46 preferably having about a ¼ inch radius.

While the invention herein disclosed has been described by means of specific embodiments and applications thereof, numerous modifications and variations could be made thereto by those skilled in the art without departing from the scope of the invention set forth in the claims.

We claim:

1. A desk shield, comprising:

a transparent face;

transparent left and right wings hingedly attached to right and left sides of the face; and curved elbow cutout in outside bottom corners of each wing, wherein the curved elbow cutouts are "S" shaped and continue downward starting parallel with the rear edges of the wings, curve toward the face of the desk shield, and then curve down to the bottom edges of the wings.

2. The desk shield of claim 1, further including clips fixable to a desk or table top, the clips configured to engage bottom edges of the desk shield to retain the desk shield on the desk or table top.

3. The desk shield of claim 2, wherein the clips comprise three clips, one clip engaging the left wing, the face, and the right wing of the desk shield.

4. The desk shield of claim 2, further including a template including cutouts for positioning the clips on the desk or table top.

5. The desk shield of claim 1, wherein flexible hinges hingedly attach the left and right wings to the face.

6. The desk shield of claim 5, wherein flexible hinges are rubber or cloth hinges.

7. The desk shield of claim 5, wherein flexible hinges are rubber hinges.

8. The desk shield of claim 5, wherein flexible hinges are rubber, Polyvinyl Chloride (PVC) tape, vinyl, or polyester ballistic nylon hinges.

9. The desk shield of claim 1, wherein the face and the left and right wings include slots providing handles, and the slots align when the left and right wings are folded against the face.

10. The desk shield of claim 1, further including a fold down work surface hingedly attached to the face, foldable against the face under the left and right wings for carrying, and foldable against a desk or table top to provide a sanitary work space.

11. The desk shield of claim 1, wherein the S shaped elbow cutouts are generally vertical proximal to the bottom edges of the wings.

12. A desk shield, comprising:

a face;

left and right wings attached to right and left sides of the face;

slots in the face, the right wing, and the left wing, and the slots align when the left and right wings are folded against the face providing handles;

hinges attaching the left and right wings to the face, the hinges made from are rubber, Polyvinyl Chloride (PVC) tape, vinyl, or polyester ballistic nylon hinges;

three clips for attaching the desk shield to a desk or table top, one clip for the face and one clip for each of the left and right wings;

elbow cutout in both the outside bottom corners of each wing, the elbow cutouts have no sharp corners; and a template including cutouts for positioning the clips on the desk or table top.

13. A desk shield, comprising:

a transparent face;

transparent left and right wings hingedly attached to right and left sides of the face; and curved elbow cutout in outside bottom corners of each wing;

a fold down work surface hingedly attached to the face, foldable against the face under the left and right wings for carrying, and foldable against a desk or table top to provide a sanitary work space, wherein:

the wings have a horizontal width W1; and the fold down work surface reaches away from the face towards a user a horizontal distance generally equal to the horizontal width W1.

14. A desk shield, comprising:

a transparent face;

transparent left and right wings hingedly attached to right and left sides of the face; and curved elbow cutout in outside bottom corners of each wing;

a fold down work surface hingedly attached to the face, foldable against the face under the left and right wings for carrying, and foldable against a desk or table top to provide a sanitary work space, wherein the fold down work surface reaches past the curved elbow cutouts towards a projection of rear edges of the wings onto the desk or table top.

* * * * *